US006170450B1

(12) United States Patent
Cecur

(10) Patent No.: US 6,170,450 B1
(45) Date of Patent: Jan. 9, 2001

(54) HYDRAULIC TAPPET WITH CONTROLLED LIFT LOSS

(75) Inventor: Majo Cecur, Rivarolo Canavese (IT)

(73) Assignee: Eaton Corporation, Cleveland, OH (US)

( * ) Notice: Under 35 U.S.C. 154(b), the term of this patent shall be extended for 0 days.

(21) Appl. No.: 09/416,163

(22) Filed: Oct. 11, 1999

(30) Foreign Application Priority Data

Oct. 13, 1998 (IT) ..... MI98A2190

(51) Int. Cl.[7] ..... F01L 1/25

(52) U.S. Cl. ..... 123/90.55; 123/90.65; 74/569

(58) Field of Search ..... 123/90.48, 90.49, 123/90.51, 90.52, 90.55, 90.65; 74/569

(56) References Cited

U.S. PATENT DOCUMENTS 4,470,381 * 9/1984 Buente et al. ..... 123/90.55
4,924,825 * 5/1990 Speil ..... 123/90.55
6,021,751 * 2/2000 Spath ..... 123/90.55
6,076,491 * 6/2000 Allen ..... 123/90.16

* cited by examiner

*Primary Examiner*—Weilun Lo
(74) *Attorney, Agent, or Firm*—L. J. Kasper

(57) ABSTRACT

A hydraulic tappet (5) comprises an inverted cup-shaped element with an upper disk (51), welded to a cylindrical body (52) of the tappet which is internally provided with a flange (54), forming a tubular guide sleeve (55) for the axial movement of an internal assembly comprising a movable reservoir portion (57) for low-pressure oil. The tappet has interposed, between an internal surface **(51*s*) of said upper disk (51) of said tappet (5) and a rim (57) of the reservoir portion, an elastic device (A), comprised of two elements (10,20), in order to achieve a rapid recovery of lift loss of said tappet (5) so as to improve the contact between the cam (2) of the cam shaft (1) and the disk (51) of the tappet (5). One result is to eliminate undesirable, early opening of the poppet valve (4) whenever the fuel injector cam (6)** deflects under load.

7 Claims, 3 Drawing Sheets

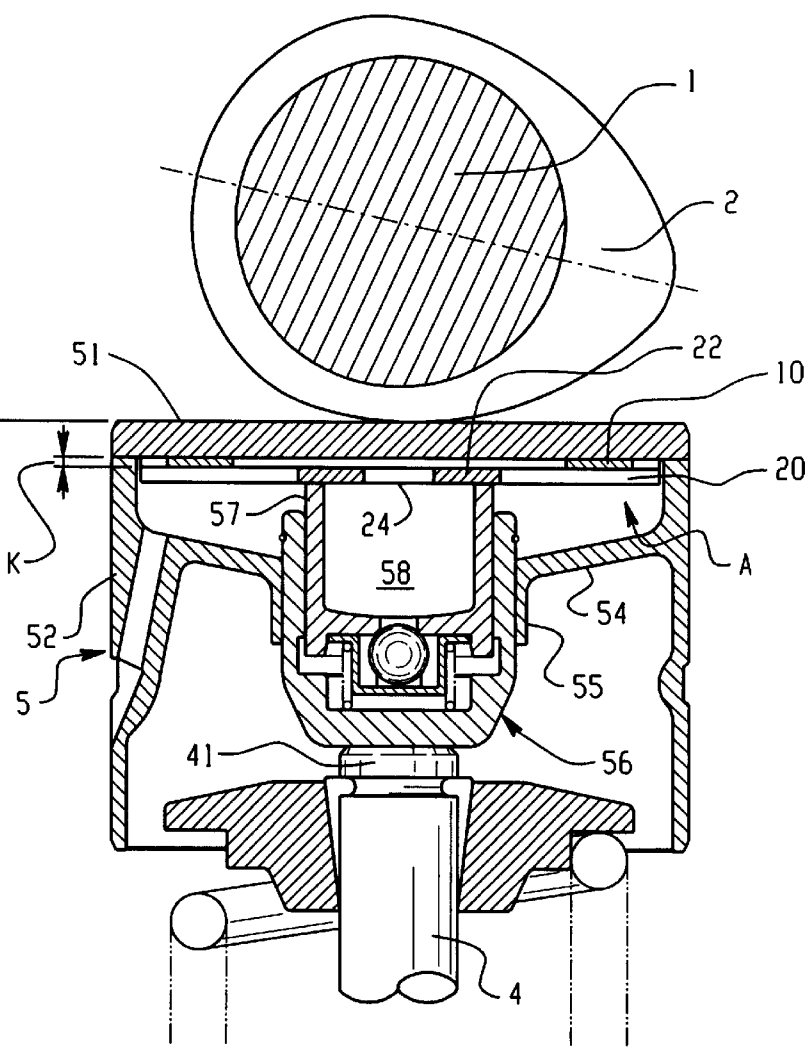
Fig. 2.2
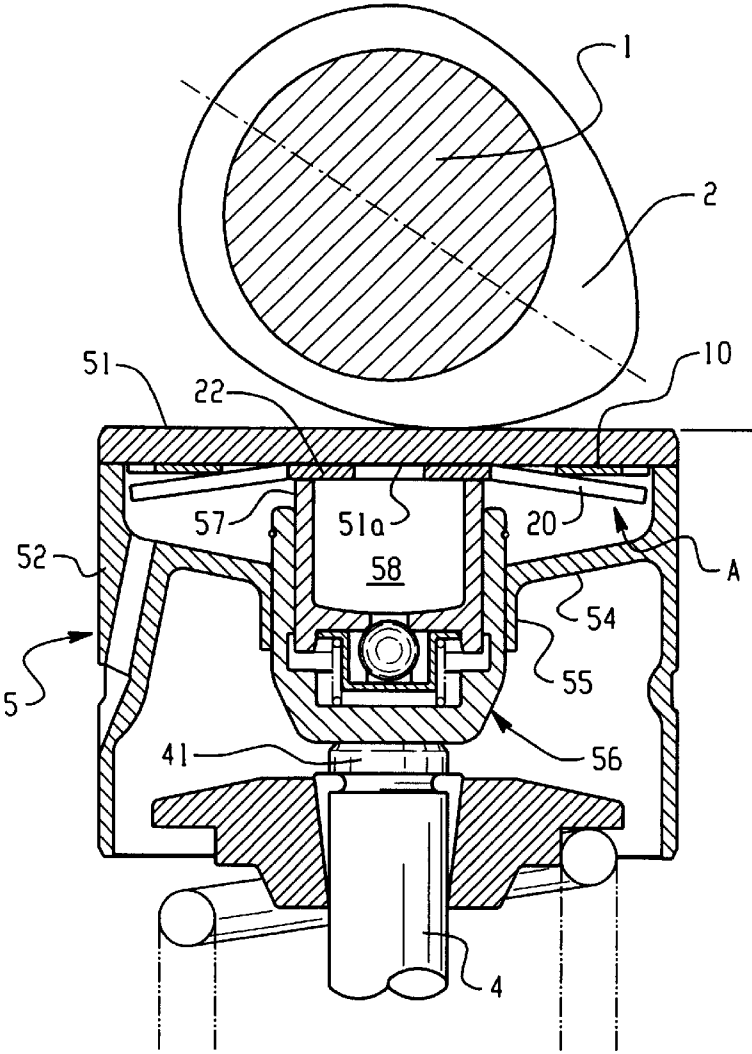
Fig. 2.1

HYDRAULIC TAPPET WITH CONTROLLED LIFT LOSS

CROSS-REFERENCE TO RELATED APPLICATIONS

This application claims priority, under 35 U.S.C. 119, of earlier-filed Italian Application MI98A002190, filed Oct. 13, 1998.

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention concerns an improved hydraulic tappet, which besides being especially suitable for application to diesel engines also proves advantageous for normal internal combustion engines.

As is known, in some diesel engines the distribution shaft (cam shaft), in addition to having cams acting by sliding against the disk of the hydraulic tappet associated with each poppet valve head (or stem), also has a second series of cams. Each cam of this second series of cams is rotationally displaced relative to the respective cam for controlling the engine poppet valve. The second cams indirectly control the diesel fuel injectors at the proper time by means of a rocker arm.

The actuation of the diesel fuel injectors constitutes a further load on the camshaft, subjecting it to a downward deflection, which also influences the functioning of the cam that is supposed to actuate the cylinder poppet valves arranged on the same shaft. Such a deflection of the cam shaft results in an irregular opening of the valves and, consequently, a poor functioning of the engine.

In fact, the conventional hydraulic tappet, by its construction, is unable in certain cases to follow, with sufficient speed, the "lift loss" of the hydraulic tappet which, instead of causing the valve to open, collapses by virtue of the size of the deflection of the camshaft. It should be understood that as used herein and in the appended claims, the term "lift loss" will mean and include the lost motion which occurs within the tappet as a result of the deflection of the injector cam, so that the engine poppet valve doesn't open.

BRIEF SUMMARY OF THE INVENTION

The purpose of the invention is to guarantee that the engine poppet valves do not open by virtue of the deflection of the camshaft, but only under the command of the valve control cams.

According to the invention, in a conventional hydraulic tappet of the type formed by an inverted cylindrical cup, closed at the top by the cam contact disk, it is proposed to insert, directly beneath the contact disk itself, an additional elastic device comprised of two different elements, of which:

- the first element, directly supported on the internal surface of the disk of the tappet, is comprised of a flat ring equipped with peripheral spacing elements which keep it centered within the internal cylindrical wall of the tappet itself; and
- the second element, placed beneath the preceding one and having the function of a leaf spring, is formed by preferably three elastic arms (or spokes), arranged in a rosette at equal distance from each other and combined with a central junction disk with a central borehole. The central junction disk is supported against the rim of the low-pressure oil reservoir portion so as to form a cushioning element between the disk of the tappet and the valve stem, the disk being placed in series in the normal kinematic force path of the hydraulic tappet.

The diameter of the central disk joining the elastic leaf arms of the second element is much less than the inner diameter of the ring comprising the first element. Consequently, when the two elements are pressed against each other, the central disk of the second element can go completely inside the ring itself, causing a bending of the leaf arms which strike against the inner edge of the circular ring formed by said first element. This generates an elastic force tending to flatten the second element (elastic leaf element), centrally supported on the low-pressure oil reservoir portion of the hydraulic tappet and, peripherally, on the ring of the first element, ensuring a prompt axial recovery of the travel of the tappet by an amount equal to the thickness of the ring comprising the first element.

In fact, the cushioning assembly comprised of the first and second elements is active until such time as the arms of the leaf spring comprising the second element are parallel to the surface of the first element and close against it, producing a recovery of lift loss equal to the thickness of the first element.

Specifically, the thickness of the first element should be calibrated so as to be at least equal in magnitude to the loss of recovery of the tappet, or the "lift loss", which is estimated or experimentally deduced with respect to a tappet used in a particular type of engine. The invention is intended to produce a repeatable total lift loss equal to the injector cam deflection which is imparted to the tappet while it is on the valve cam base circle. The total lift loss is equal, in turn, to the lost motion which occurs within the tappet plus the leakdown which occurs within the hydraulic element of the tappet.

BRIEF DESCRIPTION OF THE DRAWINGS

The present invention shall now be described in detail with respect to the enclosed drawings, showing by way of example a preferred embodiment, in which:

FIGS. 2.1 and 2.2 represent, in fragmentary section, and on an enlarged scale, a tappet provided with the elastic element according to the invention, in two different working conditions, namely:

FIG. 2.1 shows the elastic device according to the invention in an extreme condition of maximum elastic engagement or maximum capacity for restitution of elastic energy; and FIG. 2.2 shows the elastic device according to the invention in an extreme condition in which the restitution of elastic energy is nil, when the contact between the tappet and the distribution cam occurs on the base circle of the cam;

DETAILED DESCRIPTION OF THE PREFERRED EMBODIMENT

In the figures, corresponding elements have been identified by the same reference symbols.

Figure 1:
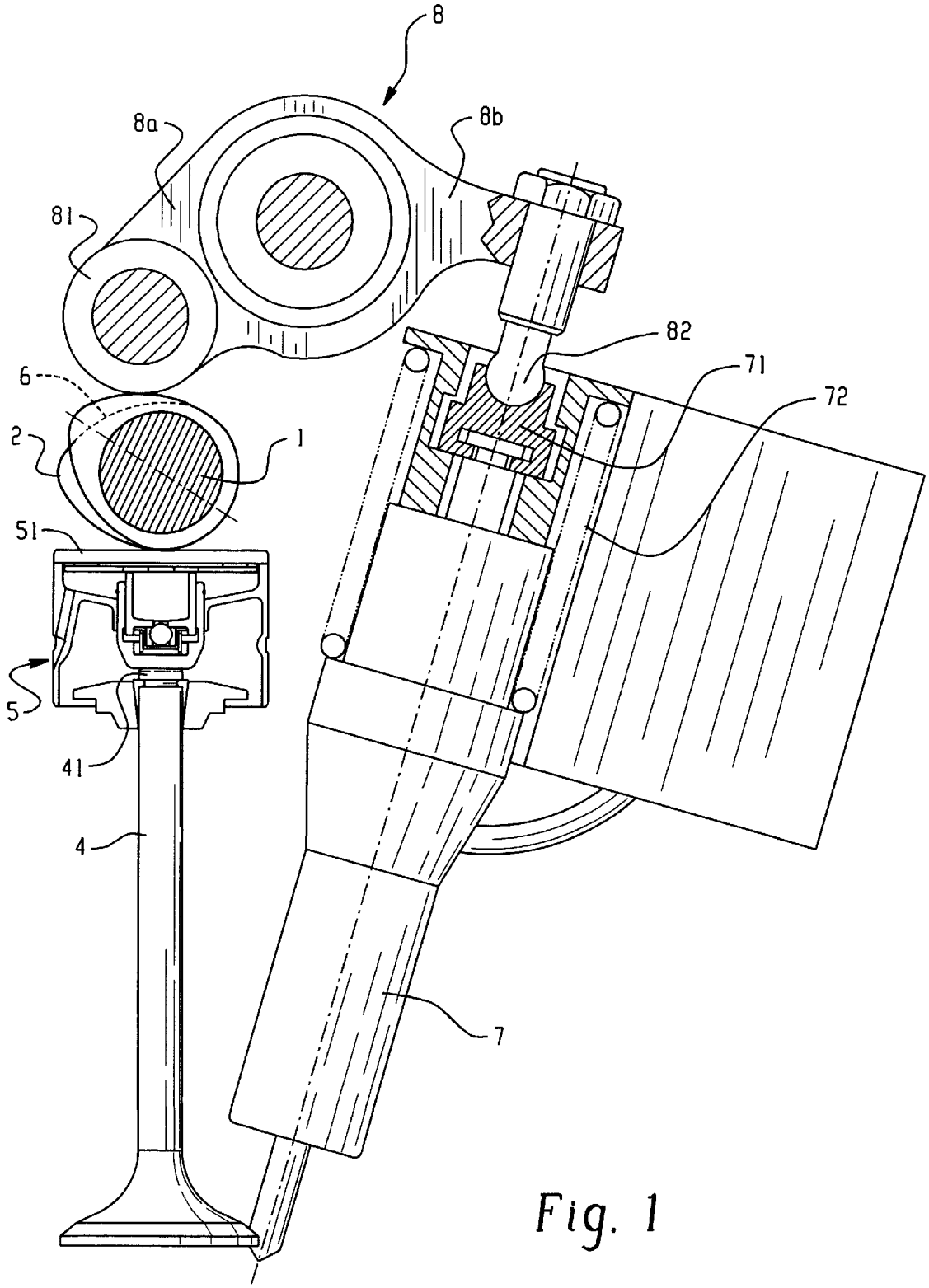
FIG. 1 represents, in somewhat schematic, lateral elevated view, partially in section, a distribution assembly pertaining to a diesel engine cylinder with direct fuel injection pump.

FIG. 1 shows, as an example, the schematic arrangement of a control assembly for a valve of a diesel engine cylinder operated by a distribution shaft (cam shaft) 1, equipped with a cam 2 to control the opening of an engine poppet valve 4 of the engine cylinder by means of a hydraulic tappet 5 of known type. Also mounted on the cam shaft 1 is a cam 6, suitably displaced in phase with respect to the cam 2, for control of a fuel injector pump 7 by means of a rocker arm 8. One arm portion 8*a* of the rocker arm 8 is equipped with a contact roller 81 for the cam 6, while an opposite arm portion 8*b* transmits pressure pulses at an end 71 of the injector pump 7 by means of a spherical head 82.

The opposing force developed by the fuel oil pressure is transmitted across the roller 81 to the cam 6 and, therefore, to the cam shaft 1, which bends downward, also producing a downward movement caused by such bending, and also transmitting such deflection to the valve cam 2 and therefore to the disk 51 of the tappet 5. The conventional hydraulic tappet does not provide sufficient lost motion to prevent unintended opening of the poppet valve 4, thus resulting in a poor functioning of the engine, for example, a corresponding drop in cylinder pressure.

FIGS. 2.1 and 2.2 show, in cross section, the hydraulic tappet 5 of generally conventional type, which includes a cylindrical body 52, and is internally provided with a flange 54, forming a guide sleeve 55 for guiding the movement of a lash adjuster assembly 56. The assembly 56 includes a low-pressure oil reservoir portion 57 having an upper rim which will also bear the reference numeral 57. Disposed within the reservoir portion 57 is a low-pressure oil reservoir 58, the function of which is generally well known in the art.

The structure described up to this point is generally well known in the hydraulic tappet art. To overcome the above-described disadvantage of the conventional hydraulic tappet, the present invention is provided with an additional elastic device (assembly), generally designated by the reference "A".

Figure 3:
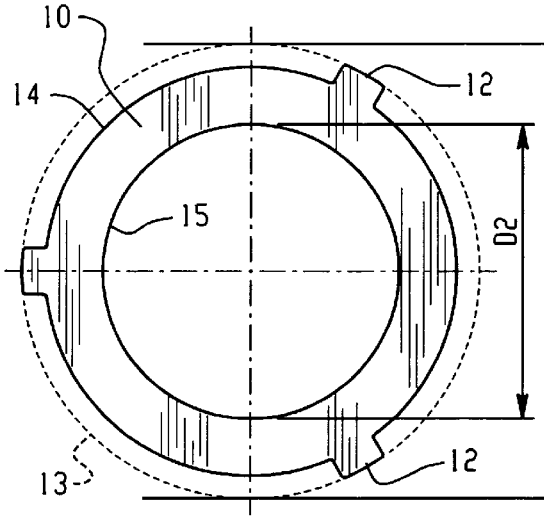
FIG. 3 shows, in plan view, the first element of the elastic device for recovery of lift loss of the tappet.

The elastic device A is comprised of a first flat ring 10 (shown in particular in FIG. 3), provided, in the subject embodiment, with three self-centering fins 12 projecting outwardly and equally spaced by 120°, the fins being bounded externally by an envelope circumference 13 whose diameter D1 is congruent with (approximately equal to) the internal diameter of the body 52 of the tappet 5, thus allowing a self-centering of the element 10 within the tappet body 52. Alternatively, the ring 10 could be self-centering by having its diameter be approximately equal to the diameter D1, rather than having separate fins 12. All that is essential is that the proper function occur, as will be described subsequently.

The ring 10 is obtained by cutting out, preferably from a steel sheet, having a thickness selected as a function of the magnitude of the recovery of tappet lift loss that it is desired to obtain, as shall be better explained hereafter. Alternatively, the ring 10 could be formed integrally with the disk 51, and references hereinafter, and in the appended claims, to the items 10 and 20 as separate elements will be understood to include the possibility of the ring 10 being integral with the disk 51.

Figure 4:
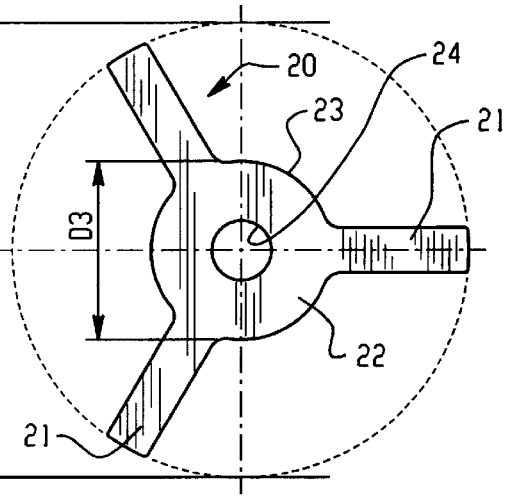
FIG. 4 shows, in plan view, the second, elastic leaf element of said elastic recovery device.

A second element 20 of the elastic device A (see FIG. 4) is comprised, in this sample embodiment, by a rosette-shaped member having three spokes (arms) 21, obtained by cutting out the element 20 from a sheet of spring steel. The arms 21 act as leaf springs in concert with the first element 10. The radial extent of the spokes 21 is limited by a circumference having the same diameter D1 as the envelope circumference 13 of the fins 12 of the ring 10.

It should be noted that the provision of three of the fins 12 and three of the spokes 21 is not an essential feature of the invention, but it is preferred to provide three of each because three is the fewest number of each (fins and spokes) which will easily enable the respective element (ring 10 or element 20) to have a self-centering capability. More than three of the fins 12 could be provided, or more than three of the spokes 21 could be provided, but such would in most cases not result in any particular advantage, structurally or functionally.

The spokes 21 are integral with and connected to a central plate 22 of preferably circular shape, and having a diameter D3, the diameter D3 of the plate 22 being less than an internal diameter D2 of the first element 10. The diameter D3 of the outer circumference 23, which bounds the central plate 22 of the second element 20, is fitted to the diameter of the low-pressure oil reservoir portion 57 (see FIG. 2.1 or 2.2) such that said central plate 22 should rest on the rim 57 of said reservoir portion, as can be seen in FIGS. 2.1 and 2.2, to form with it an incompressible kinematic continuity when said central plate 22 comes in contact with an internal surface 51*s* of the disk 51 of the tappet 5 (FIG. 2.1). The plate 22 has a central opening 24 to facilitate the entrance of the oil into the low-pressure oil reservoir 58.

Figure 5:
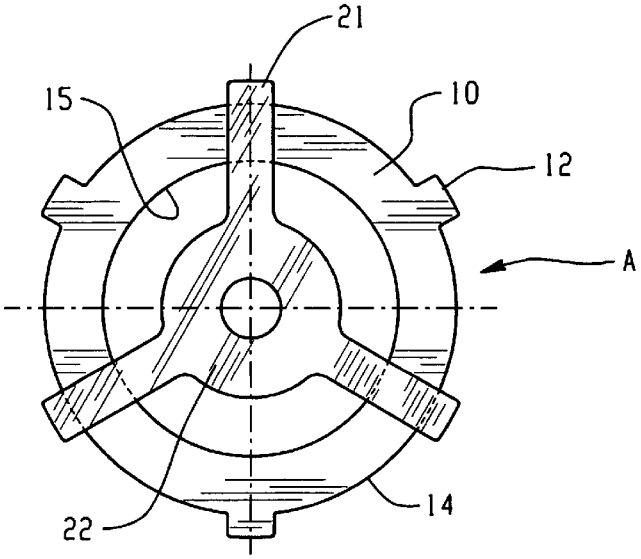
FIG. 5 shows, in plan view, looking upward in FIGS. 2.1 and 2.2, the elements of FIGS. 3 and 4 above, in their assembled, operating position.

According to this configuration, considered along with FIG. 5, it may be seen that the leaf spokes 21 of the second element 20 bend while abutting the lower edge formed by an internal circumference 15 of the first element 10, with a consequent elastic thrusting of the disk 22 onto the low-pressure oil reservoir 57 until the spokes 21 are aligned parallel with the ring 10. Therefore, the internal diameter D2 of the ring 10 determines the lever arm action of the spokes 21. Although in FIG. 5, the ring 10 and second element 20 are shown in a particular relative rotational orientation, those skilled in the art will understand that such a relative orientation is by way of example only, and that the relative rotational orientation is unimportant, and will probably change during operation of the tappet anyway.

The elastic action of elastic device A according to the invention, cooperating in series with the normal kinematic force path of the hydraulic tappet 5, increases the efficiency of the tappet in regard to its recovery corresponding to the thickness K of the first element 10 which is preferably selected such as to be equal to or slightly greater than the "lift loss" K' to be recovered. As mentioned previously, the lift loss will be the sum of the lost motion within the tappet and the leakdown within the lash adjuster assembly 56.

It should be apparent to one skilled in the art that although the invention has been described in terms of a pair of elements 10 and 20, of particular configuration, the invention can be practiced by providing various other forms of elastic assembly A, as long as the particular assembly or element selected is able to perform the function described hereinabove. For example, the elastic assembly A could comprise a Belleville washer selected to have both the appropriate displacement and biasing force versus displacement characteristics.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A hydraulic tappet comprising an inverted cup-shaped element with an upper disk, welded to a cylindrical body of the tappet which is internally provided with a flange, forming a tubular guide sleeve for the axial movement of an internal assembly comprising a movable reservoir portion for low-pressure oil; characterized by the fact that between an internal surface of said upper disk of said tappet and a rim of the reservoir portion there is interposed an elastic device, comprising two elements, in order to achieve a rapid recovery of lift loss of said tappet so as to improve the contact between a cam of a cam shaft and the disk of the tappet.

2. A hydraulic tappet according to claim 1, characterized by the fact that the first component of the elastic device is comprised of a flat ring, equipped with three fins projecting outwardly, equally spaced, the size of said fins being bounded externally by a circumference whose diameter is congruent with the internal diameter of said body of said tappet in order to produce a self-centering of the said ring within said tappet.

3. A hydraulic tappet according to claim 2, characterized by the fact that said internal diameter of said ring is selected to obtain a desired lever arm action of each of a plurality of spokes of said second component.

4. A hydraulic tappet according to claim 3, characterized by the fact that the second component of said elastic element is comprised of a rosette member, having three equally spaced and integral spokes, connected to a central plate whose diameter is fitted to that of said upper rim of said low-pressure oil reservoir portion, on which rim said plate is disposed to rest, said plate having a central opening to allow the passage of oil into said reservoir.

5. A hydraulic tappet according to claim 4, characterized by the fact that the thickness of said ring is proportional to the lift loss to be recovered by means of said elastic device.

6. A hydraulic tappet according to claim 5, characterized by the fact that said first component of the elastic element comprises said ring, and is formed by cutting said ring from a metal sheet.

7. A hydraulic tappet according to claim 5, characterized by the fact that said second component of said elastic element is formed by cutting out said rosette member from a sheet of spring steel.

* * * * *